US006652127B2

(12) United States Patent
Tarabula

(10) Patent No.: US 6,652,127 B2
(45) Date of Patent: Nov. 25, 2003

(54) LIGHT UNIT SHIELD DEVICE

(76) Inventor: Michael A. Tarabula, 3056 Park La., Chamblee, GA (US) 30341

( * ) Notice: Subject to any disclaimer, the term of this patent is extended or adjusted under 35 U.S.C. 154(b) by 0 days.

(21) Appl. No.: 10/078,848

(22) Filed: Feb. 19, 2002

(65) Prior Publication Data

US 2003/0156419 A1 Aug. 21, 2003

(51) Int. Cl.[7] ..... F21V 15/02
(52) U.S. Cl. ..... 362/376; 362/377; 362/378
(58) Field of Search ..... 362/376, 377, 362/378

(56) References Cited

U.S. PATENT DOCUMENTS 524,168 A * 8/1894 Galster
715,254 A 12/1902 Garretson
2,210,489 A 8/1940 Lemmens et al. ..... 176/16
2,383,116 A 8/1945 Elg ..... 240/102
2,610,285 A * 9/1952 Rusnak et al.
D251,147 S * 2/1979 Young et al. ..... D48/20 K
4,577,265 A 3/1986 Krause, Jr. ..... 362/255
4,616,299 A 10/1986 Krause, Jr. ..... 362/255
4,959,762 A 9/1990 Soilean ..... 362/376
5,660,464 A * 8/1997 Lin ..... 362/376

* cited by examiner

*Primary Examiner*—Laura K. Tso
(74) *Attorney, Agent, or Firm*—The Halvorson Law Firm

(57) ABSTRACT

Described is a protective device for protecting a light unit that leaves the light output either unaffected or slightly to moderately attenuated. Further, the protective device of the present invention may increase the protection and containment of shattering glass components resulting from internal malfunction explosion or object impact strike. Additionally, the protective device of the present invention increases protection against direct contact with extremely hot glass surfaces during normal operation of a quartz type lamp.

16 Claims, 3 Drawing Sheets

LIGHT UNIT SHIELD DEVICE

FIELD OF THE INVENTION

The present invention relates to a device for protecting a flash, strobe or modeling light tube. This protection may include a filtering or light attenuation effect.

BACKGROUND

A typical photo strobe unit consists of a power pack unit and a strobe or flash head. The flash head has two separate and different lighting sources, a modeling light and a flash tube. The modeling light, typically is a tungsten lamp, provides light used to simulate the light output from the flash tube, to light the subject for focusing, and to be the general light used for setup and styling or arrangement of the subject to be photographed. The flash tube, and sometime the modeling light, when fired, provides the actual light that exposes the film or digital image sensor.

The tubes of these units are subject to destructive forces, such as accidental impact, internal malfunction, and the like. When this happens, due to the vacuum within the tubes, implosion results and glass shards typically are strewn about with not inconsiderable force. This is a particularly dangerous situation when the light units are at their normal operating temperatures, which is extremely high.

There are examples in the prior art of protectors for electric lamps and light bulbs. For example, U.S. Pat. No. 715,254, issued to Garretson, discloses an electric lamp protector comprising a cage assembly that may be covered with a wire cloth. This is a single piece device intended and developed to protect a single enclosed bulb.

U.S. Pat. No. 2,210,489, issued to Lemmens et al., discloses a wire net (helical spring form) that is integrally attached to an outer surface of a light bulb. Because of the integral attachment, this device is not removeable, changeable, or replaceable.

U.S. Pat. No. 2,383,116, issued to Elg, discloses a wire mesh light bulb protector that is designed to encompass a single bulb.

U.S. Pat. No. 4,959,762, issued to Soilean, discloses a light bulb assembly with a wire mesh protector integral to the assemble and interposed between a light bulb and a window area of the assembly. Since this device is an assemble, it necessarily protects the single enclosed bulb. Further, the wire mesh of this assembly, since it is integral to the assemble, is also necessarily not easily removable, changeable or replaceable.

Thus it can be seen that there is an existing and continuing need for devices that can protect either a portion, or all, of a multi-bulb light unit and still allow light to emanate from the unit to a subject to be illuminated. Further, there is a continuing need for these protector devices to be easily removable, changeable or replacable.

SUMMARY OF THE INVENTION

The present invention relates to a protective device for protecting multi-light bulb units.

It is an object of the present invention to provide a protective device that fits over a flash tube and/or modeling light of a dual light photo strobe unit.

It is another object of the present invention wherein said protective device is comprised of a mesh like material that allows a reduction in the amount of light provided by the light unit.

It is a further object of the present invention wherein said mesh-like material is a metallic material that does not melt at temperatures created by flash tube use.

It is yet another object of the present invention to provide a series of differently sized protective devices that may be nestled within each other in order to provide a controllable reduction in the amount of light provided by the flash tube and/or modeling light.

It is still yet a further object of the present invention to provide a variety of different shaped protective devices that will conform to the different shapes and models of photo strobe units and be easily changeable, removable or replaceable.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS

Figure 1:
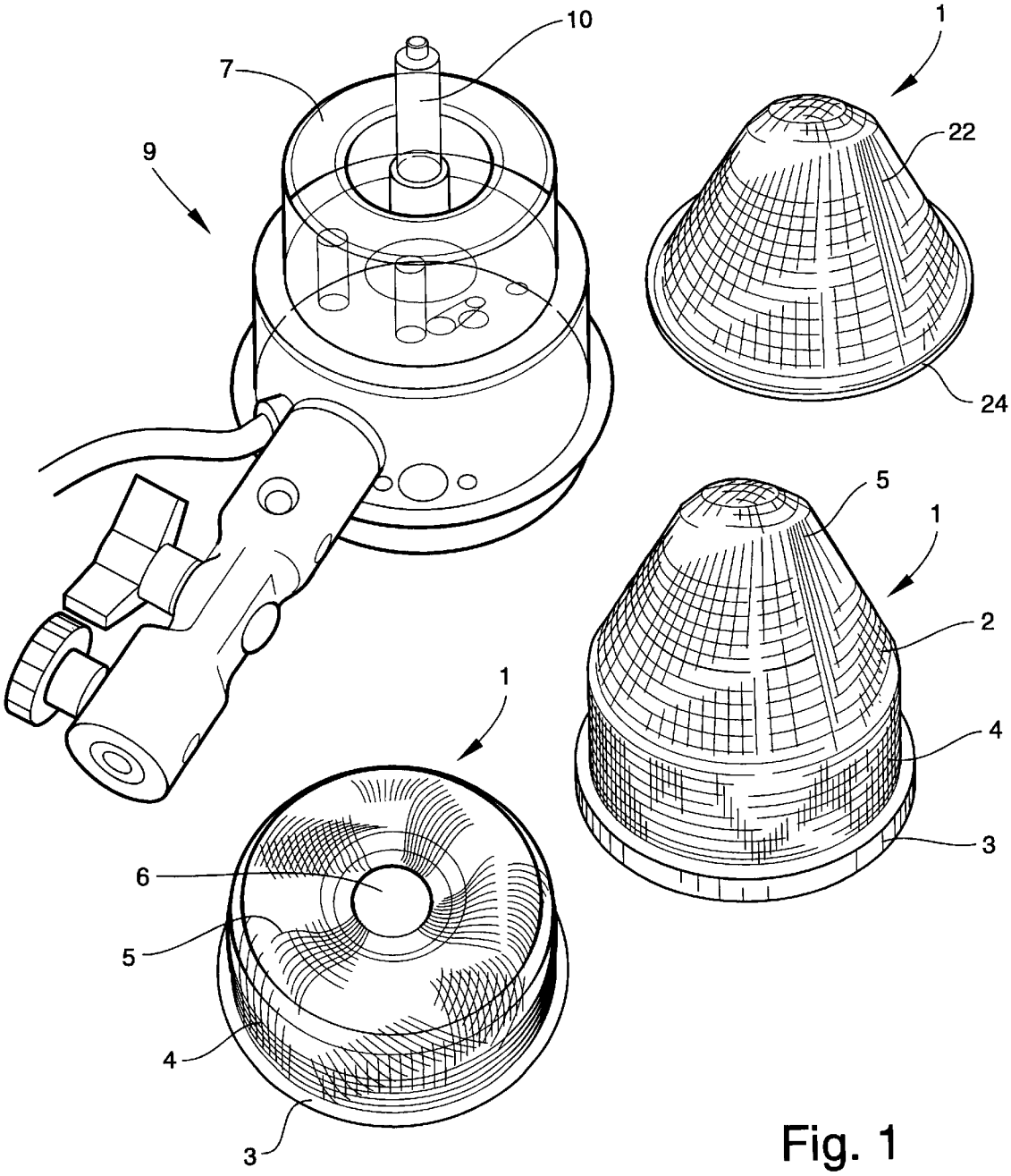
FIG. 1 shows three separate shield devices for an accompanying photo strobe unit. The larger screen shield device covers both the flash tube and the quartz modeling lamp.

The present invention relates to a protective device 1 for protecting a light unit 7, while leaving the light output either unaffected or slightly to moderately attenuated. Further, the protective device 1 of the present invention may increase the protection and containment of shattering glass components resulting from internal malfunction explosion or object impact strike. Additionally, the protective device 1 of the present invention increases protection against direct contact with extremely hot glass surfaces during normal operation of a quartz type lamp.

The present invention is a protective device 1 comprised of a body 2 that is sized to fit over a light unit 7 in a photo strobe unit 9. The body 2 may fit over the flash tube 8, the modeling light tube 10, or both. It its preferred embodiment, the protective device 1 has axial symmetry. It a most preferred embodiment, the protective device 1 has a circularly shaped lip 3, a tubular or conical sidewall 4 that extends from the base to an enclosing top section 5. The top section 5 may include an aperture 6 through which the modeling light 10 may project, when the protective device 1 is placed upon a photo strobe unit 9.

In one embodiment, when there is first body 2 with a aperture 6 through which the modeling light 10 may project, a second protecting body 22 that is substantially conical in shape and having a lip 24, may be included. This second body 22 may be attached to the top of the first body 2, thereby covering and protecting the modeling light 10, according to the users needs and wishes.

The bodies 2 and 22 of the protective device 1 is necessarily made of a material that can absorb, or withstand, temperatures generated by close proximity to a light unit 7, when the light unit 7 is in use. Further, the bodies 2 and 22 of the protective device 1 may be able to block a portion of the light emitted by the light unit 7, thereby reducing the amount of light provided by the light unit external to the protective device 1. Accordingly, the most preferred material is a mesh-like material wherein the solid portions of the mesh completely block the emitted light and the open portion allow some of the emitted light to be used external to the protective device 1. It is most preferred that the mesh material be made from a metallic mesh or weave. These wire mesh or screen material allows cooling airflow and improve heat dissipation and dispersion with minimum light output reduction, preferably the mesh will be a silver or light reflecting colored material.

Alternately, the solid portions of the mesh may absorb some or all of the impinging light, instead of physically blocking the light. When the solid portions of the mesh absorb a portion of the impinging light, a portion may be transmitted, thereby allowing its use external to the protective device 1. When a portion of the emitted light is transmitted through the solid portion of the mesh, the open portion of the mesh may be decreased in size from that required if the solid portion physically blocked, or completely absorbed, the impinging light. Further, combinations of blocking and absorbing are considered to fall within the scope of the present invention.

Figure 3:
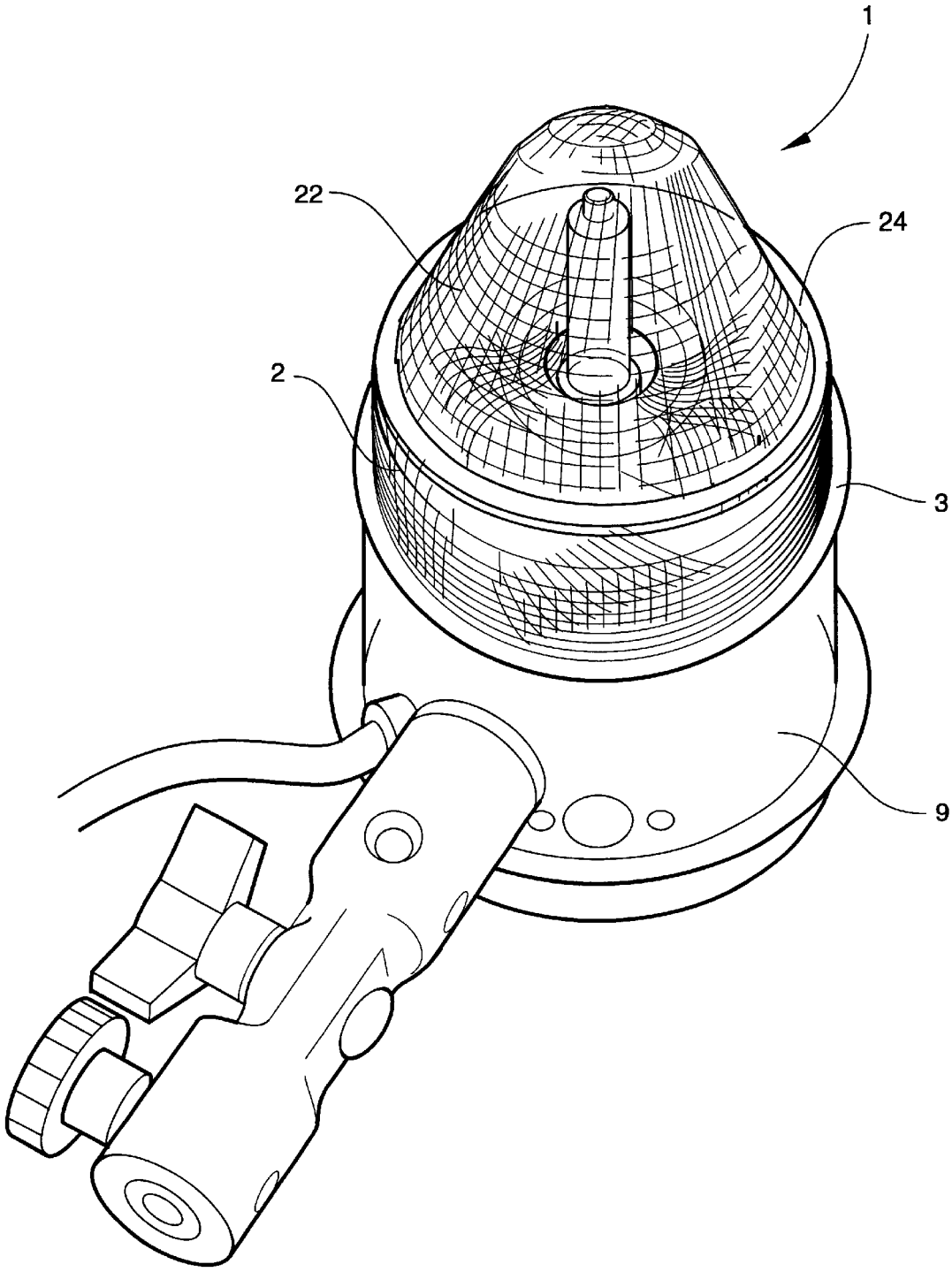
FIG. 3 shows the small shield cover protecting the modeling light, said shield attaches by the bottom edges being curved under or inward and by these curved or bent wire edges grabbing and locking into the screen mesh material openings of the larger black shield cover.

Other shapes that block the output of the light unit 7 are considered to fall within the scope of the present invention. Example shapes are illustrated in FIG. 3.

It should be noted that the mesh material in the preferred embodiment causes the light output to be diffused, resulting in an improved simulated light output of the light unit 7. Without the protective device 1, the light unit 7 displays more point source light characteristics than the larger and broader profile of a flash tube light output.

Figure 2:
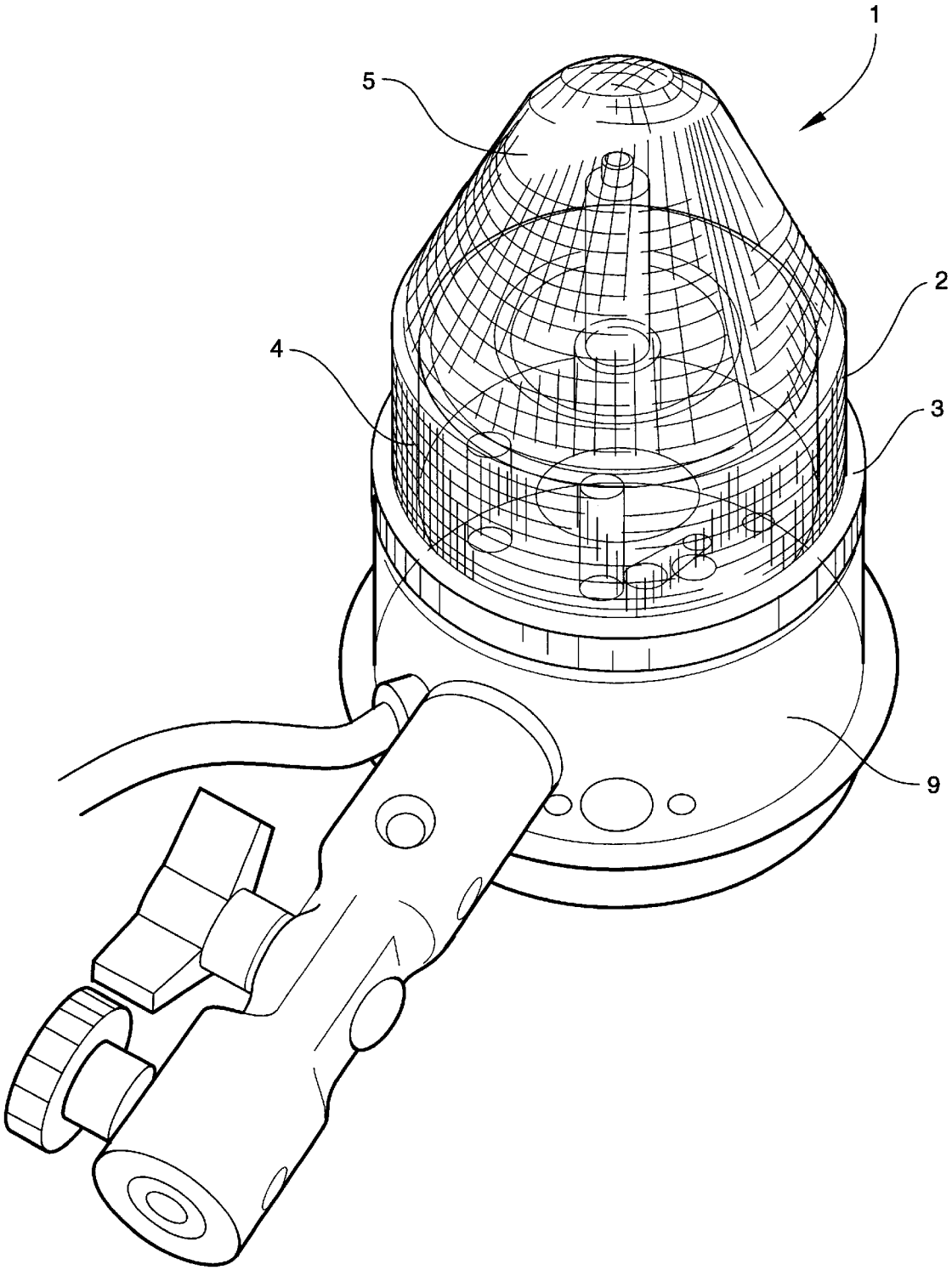
FIG. 2 shows the full cover fitting on the flash head and encompassing the modeling light.

In use, the protective device 1 according to the present invention is physically secured over the light unit 7 of a photo strobe unit, as illustrated in FIG. 2. The modeling light element 10 may project through the aperture 6 in the top 5, thereby allowing the light output from the modeling light 10 to be unaffected. Preferably, the protective device 1 according to the, present invention is sized to frictionally fit and secure to the photo strobe unit via a lip 3 or 24 that may be formed by turning the edge of the body 2 under and into itself. Alternately, the lip 3 or 24 may include a friction coating such as high temperature silicon, which covers a small portion around the lip 3 or 24 of the bodies 2 or 22, that aids in securing the device 1 to the light unit 7.

In one embodiment, the mesh is a black screen reduces the light output of the quartz lamp without changing the color temperature output of the lamp. This is useful in cases where reducing the quartz light output by means of a dimmer switch also reduces the color temperature of the light output. Further, in the embodiment where there are first and second devices, one may be metallic or silver in color and the other may be black, thereby allowing at least four different color/temperature configurations to the ensemble.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A protective device comprising a first body that is sized to fit over a flash tube in a dual light, photo strobe unit, and allows a modeling light to project therethrough, and a second body that is attachable to the first body and is sized to fit over the projecting modeling light.

2. The protective device according to claim 1 wherein body has axial symmetry.

3. The protective device according to claim 2 where in the axially symmetric body is comprised of a circularly shaped base, a tubular sidewall that extends from the base to an enclosing top section having an aperture through which a modeling light will project when the protective device is placed upon a photo strobe unit.

4. The protective device according to claim 3 wherein the body is made of a mesh-like material.

5. The protective device according to claim 4 wherein solid portions of the mesh-like material is opaque to light.

6. The protective device according to claim 5 wherein the mesh-like material is a metallic material.

7. A kit for a protective device comprising a first body that is sized to fit over a flash tube and allows a modeling light in a dual light, photo strobe unit to project therethrough when attached to the dual light, photo strobe unit, and a second body that is attachable to the first body and is sized to fit over the projecting modeling light.

8. The protective device according to claim 7 wherein body has axial symmetry.

9. The protective device according to claim 8 where in the axially symmetric body is comprised of a circularly shaped base, a tubular sidewall that extends from the base to a conical enclosing top section.

10. The protective device according to claim 9 wherein the body is made of a mesh-like material.

11. The protective device according to claim 10 wherein solid portions of the mesh-like material is opaque to light.

12. The protective device according to claim 11 wherein the mesh-like material is a metallic material.

13. A protective device comprising a first body that is sized to fit over a flash tube in a dual light and comprising a circularly shaped base, a tubular sidewall that extends from the base to an enclosing top section having an aperture through which a modeling light will project when the protective device is placed upon a photo strobe unit and a second body that, when attached to the first body fits over the projecting modeling light.

14. The protective device according to claim 13 wherein the first and second bodies are made of a mesh-like material.

15. The protective device according to claim 14 wherein solid portions of the mesh-like material is opaque to light.

16. The protective device according to claim 15 wherein the mesh-like material is a metallic material.

* * * * *